United States Patent [19]

Moser

[11] 4,197,445

[45] Apr. 8, 1980

[54] ROLL FUSER APPARATUS AND SYSTEM THEREFOR

[75] Inventor: Rabin Moser, Fairport, N.Y.

[73] Assignee: Xerox Corporation, Stamford, Conn.

[21] Appl. No.: 946,269

[22] Filed: Sep. 27, 1978

[51] Int. Cl.[2] ..... H05B 1/00; G03G 15/20

[52] U.S. Cl. ..... 219/216; 432/60; 432/228; 219/388

[58] Field of Search ..... 219/216, 388; 432/60, 432/228; 355/3 FU

[56] References Cited

U.S. PATENT DOCUMENTS

| | | | |
|---|---|---|---|
| 3,811,821 | 5/1974 | Ariyama | 219/216 |
| 3,813,516 | 5/1974 | Kudsi et al. | 219/388 X |
| 3,849,628 | 11/1974 | Abowitz et al. | 219/471 X |
| 3,874,843 | 4/1975 | Fujimoto | 219/216 |
| 4,000,957 | 1/1977 | Ruhland | 219/216 |
| 4,079,227 | 3/1978 | Takiguchi | 219/216 |

*Primary Examiner*—C. L. Albritton

[57] ABSTRACT

A heat and pressure roll fusing apparatus for fixing toner images to copy substrates, the toner comprising thermoplastic resin. The apparatus includes a heated fuser roll cooperating with a backup or pressure roll to form a nip through which the copy substrates pass at relatively high (i.e. 12–20 in./sec) speeds with the images contacting the heated roll. The heated fuser roll is characterized by a relatively thick (i.e. 10 mils or greater) outer layer or surface which by way of example is fabricated from a highly insulative material such as silicone rubber or Viton to which a low viscosity polymeric release fluid is applied. Elevating the temperature of the heated roll during a standby or warm-up is accomplished by an internally disposed heating element and the operating temperature thereof during the run mode of operation is effected by an external heater.

5 Claims, 1 Drawing Figure

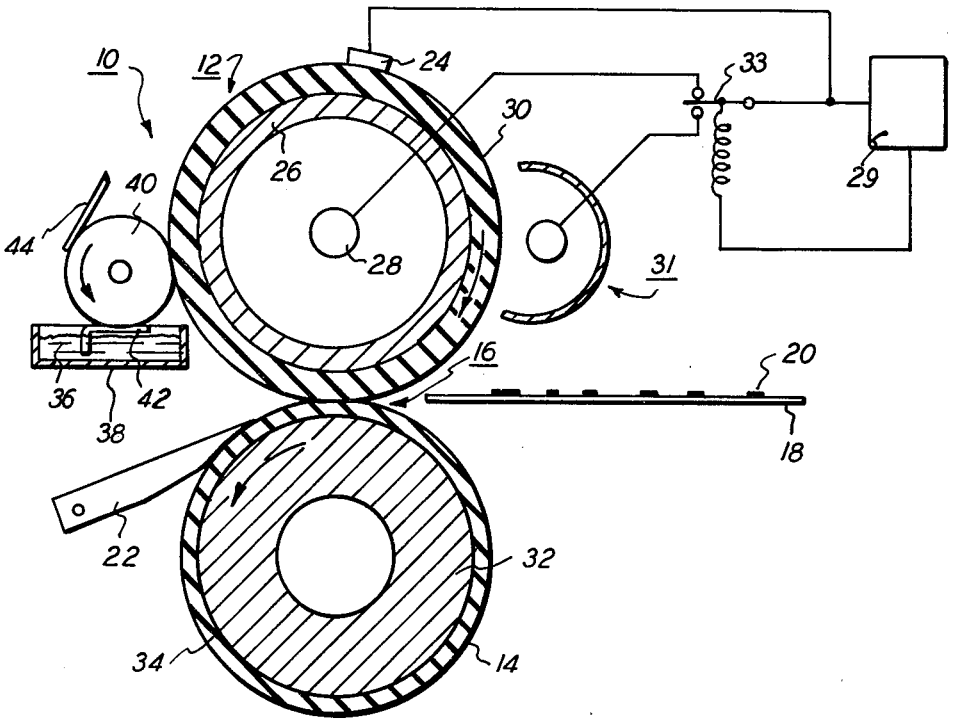
10
12
24
33
30
26
29
40
44
28
31
16
20
36
42
38
18
22
32
34
14

ROLL FUSER APPARATUS AND SYSTEM THEREFOR

BACKGROUND OF THE INVENTION

This invention relates generally to xerographic copying methods and apparatus, and more particularly, it relates to the heat and pressure fixing of particulate thermoplastic toner by direct contact with a heated fusing member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, for example, as by heat and pressure.

In order to affix or fuse electroscopic toner material onto a support member by heat and pressure, it is necessary to provide a combination of heat and pressure sufficient to condition the toner material to a point at which the constituents of the toner material coalesce and become tacky. This action causes the toner to flow to some extent into the fibers or pores of support members or otherwise upon the surfaces thereof. Thereafter, as the toner material cools, solidification of the toner material occurs causing it to be bonded firmly to the support member. In both the xerographic as well as the electrographic recording arts, the use of thermal energy and pressure for fixing toner images onto a support member is old and well known.

One approach to heat and pressure fusing of electroscopic toner images onto a support has been to pass the support with the toner images thereon between a pair of opposed roller members, at least one of which is heated. During operation of a fusing system of this type, the support member to which the toner images are electrostatically adhered is moved through the nip formed between the rolls with the toner image contacting the fuser roll thereby to effect heating of the toner images within the nip. In order to accomplish fusing in the manner described, the surface temperature of the heated fuser member is maintained at a temperature on the order of 330°–400° F. The specific temperature is usually referred to as the setpoint and where, as is customary, all of the thermal energy is provided from an internal heater, the setpoint is maintained within ±5° F. It will be appreciated that from the standpoint of cost and design simplification, a larger setpoint tolerance is desirable. It has been found that such precise setpoint requirements can be relaxed if an external source of heat is supplied for maintaining the surface temperature at the required value during using along with the provision of an internal source of heat for use during standby or warm-up.

In the higher speed copier environment (i.e., 12–20-+in./sec) where a relatively thick (i.e. 10 mils or greater) outer insulative layer is utilized for enhanced copy quality and self-stripping, heat and pressure roll fusers can be employed. However, the limitation that all of the heat be supplied from an internal source would preclude satisfactory use of known roll fusers in high speed machines. This is because at the higher speeds with an internal heat source alone the interface temperature between the core and the rubber would exceed the upper temperature limit that the contemplated rubbers could tolerate. The fuser arrangement discussed in the preceding paragraph can be satisfactorily used in the higher speed environments.

An additional advantage is also derived by supplying warm-up requirements solely by an internal heater while providing the thermal requirements for the run mode via an external heater in that the heated roll doesn't have to be rotated during standby warm-up. Contrariwise, if warm-up energy is provided by the external source it would be necessary to continuously rotate the fuser roll or in some other way prevent hot spots which would occur if the heated roll were stationary when the external source is energized.

PRIOR ART STATEMENT AND BRIEF SUMMARY OF INVENTION

While the present invention, in general, relates to roll fuser apparatuses wherein one of the rolls is heated by both internal and external sources of radiant energy as shown, for example, in U.S. Pat. No. 4,079,227, it more specifically relates to such an apparatus which can be utilized in the higher speed copier environment even though the heated roll comprises a relatively thick outer heat insulative layer. To this end, the present invention provides for elevating the heated roll of a roll fuser pair to its setpoint temperature solely by means of an internal heater which is equally spaced from all areas of the cylindrical wall surrounding it. Accordingly, the roll need not be rotated during standby.

An external source of heat which is the sole source of energy during image fusing (i.e. during the run mode of operation), is controlled such that it maintains the surface of the heated roll at approximately the setpoint temperature. In this manner, high speed fusing can be continuously accomplished.

DESCRIPTION OF THE DRAWING

The FIGURE is a side elevational schematic view of a roll fuser apparatus and release agent applying mechanism therefor.

DETAILED DESCRIPTION OF THE PREFERRED EMBODIMENT OF THE INVENTION

Referring now to the FIGURE, it can be seen that the invention is directed to a roll fuser apparatus generally indicated 10. The fuser apparatus comprises a heated roll structure 12 cooperating with a non-heated backup roll structure 14 to form a nip 16 through which a copy substrate 18 passes with toner images 20 formed thereon in a well known manner. The toner images 20 contact the heated roll structure while a force is applied between the roll structures in a well known manner to create pressure therebetween resulting in the deformation of the heated roll structure by the backup roll structure to thereby form the nip 16.

As the substrate passes out of the nip, it is stripped or guided from the backup roll structure by a plurality (only one shown) of stripping devices 22 after which it is free to move along a predetermined path toward the exit of the machine (not shown) in which the fuser apparatus 10 is to be utilized.

A contact temperature sensor 24 is provided for sensing the surface temperature of the roll structure 12 to maintain the surface temperature at a predetermined set-point value, for example, on the order of 330°–400° F.±15° F.

The heated roll structure 12 comprises a hollow cylinder 26 having a radiant quartz heater 28 disposed in the hollow thereof. When suitably energized via a power supply and controller 29, the heating element radiates heat to the cylinder which is then conducted to the outer surface of an outer deformable layer 30 of insulative material of the structure 12 which preferably comprises silicone rubber having a thickness of between 10–150 mils. Other elastomeric materials may be employed, for example, Viton (trademark of E. I. duPont). In accordance with the invention the heater 28 serves to elevate the roll structure 12 only during the standby mode of operation such that its outer surface is at approximately the setpoint temperature which will be dictated by the particular machine configuration in which the fuser is employed.

During the run mode of operation, an external heat source 31 is provided as the sole source of energy for maintaining the surface of the roll at about the setpoint temperature. A solenoid actuated switch is provided for operatively coupling the power supply 29 to the proper heater 28, 31 in accordance with the mode of operation of the fuser.

The backup roll structure 14 comprises a solid metal core 32 to which is adhered a relatively thin layer 34 of material for example an elastomer known as ethylene-propylene terpolymer which is based on stereosperific linear typolymers of ethylene, propylene and small amounts of nonconjugated diene which is commonly referred to as EPDM which layer carries a thin overcoat of PFA. Due to the construction of the backup roll structure it deforms the softer heated roll structure when the required pressure is applied therebetween, the pressure being a function of the desired deformation which corresponds to the desired length of the nip 16.

While the layer 30 tends to be abhesive, therefore, exhibits a low affinity for the toner material 20, it has been found desirable to coat the layer with a release agent material 36 contained in a sump 38. The material 36 comprises a polymeric release agent optimally having functional groups such as carboxy, hydroxy, epoxy, ammo, isogenate, thioether or mercepto groups.

For the purpose of coating the heated roll structure 12 there is provided a release agent applying mechanism comprising a rotatable hard-surfaced roll 40, a wick 42, metering blade 44 and the sump 38 containing the release material 36. The roll 40 is preferably a steel roll having a 4–32 AA finish.

What is claimed is:

1. Roll fuser apparatus for fixing toner images to copy substrates wherein a pair of rolls are supported for rotation and having pressure applied therebetween thereby forming a nip through which copy substrates pass at a relatively high rate of speed with said toner images contacting one of said rolls and wherein said one of said rolls is heated from both internal and external sources and has an insulative layer having a low affinity for the toner forming said toner images, the improvement comprising:

a relatively thick deformable outer layer; and means for energizing said internal source for maintaining the surface temperature of said heated roll at a predetermined setpoint during a standby mode of operation after which it de-energizes said internal source and energizes said external source to maintain said surface temperature at about said setpoint.

2. Apparatus according to claim 1 wherein said relatively thick outer layer comprises silicone rubber.

3. Apparatus according to claim 2 wherein said relatively thick outer layer has a thickness greater than 9 mils.

4. Apparatus according to claim 3 including means for applying silicone oil to the surface of said heated roll.

5. Apparatus according to claim 4 wherein said external source comprises a radiant heater element adapted to supply to 2000 watts.

* * * * *